US006684906B2

(12) United States Patent
Burns et al.

(10) Patent No.: US 6,684,906 B2
(45) Date of Patent: Feb. 3, 2004

(54) QUICK CONNECT/DISCONNECT WATER FAUCET CONDUIT ASSEMBLY

(75) Inventors: Leonard J. Burns, Amherst, OH (US); Nicholas A. Mascari, Newburgh Heights, OH (US); Martin Zummersch, Olmsted Falls, OH (US)

(73) Assignee: Moen Incorporated, North Olmsted, OH (US)

( * ) Notice: Subject to any disclaimer, the term of this patent is extended or adjusted under 35 U.S.C. 154(b) by 38 days.

(21) Appl. No.: 09/967,020

(22) Filed: Sep. 28, 2001

(65) Prior Publication Data

US 2003/0062087 A1 Apr. 3, 2003

(51) Int. Cl.[7] ..... E03C 1/02

(52) U.S. Cl. ..... 137/606; 285/33; 285/308; 285/313

(58) Field of Search ..... 137/606; 251/151; 285/33, 308, 313, 317, 319

(56) References Cited

U.S. PATENT DOCUMENTS

| | | | | | |
|---|---|---|---|---|---|
| 2,200,503 | A | | 5/1940 | Judell et al. | |
| 2,830,618 | A | * | 4/1958 | Mitchell | 137/599.03 |
| 4,561,682 | A | * | 12/1985 | Tisserat | 285/305 |
| 4,761,839 | A | | 8/1988 | Ganaway | |
| 4,763,693 | A | * | 8/1988 | Valley | 137/606 |
| 4,869,534 | A | * | 9/1989 | Ketcham et al. | 285/305 |
| 5,024,419 | A | | 6/1991 | Mulvey | |
| 5,033,131 | A | * | 7/1991 | Paden | 4/572.1 |
| 5,056,562 | A | | 10/1991 | Pawelzik et al. | |
| 5,104,158 | A | * | 4/1992 | Meyer et al. | 285/308 |
| 5,361,431 | A | | 11/1994 | Freier et al. | |
| 5,375,887 | A | | 12/1994 | Johnson | |
| 5,546,978 | A | | 8/1996 | Parker | |
| 5,586,792 | A | * | 12/1996 | Kalahasthy et al. | 285/319 |
| 5,624,074 | A | | 4/1997 | Parisi | |
| 5,685,341 | A | | 11/1997 | Chrysler et al. | |
| 5,845,345 | A | | 12/1998 | Ko | |
| 5,926,868 | A | * | 7/1999 | Bjerke | 4/675 |
| 5,946,746 | A | * | 9/1999 | Bloom | 4/675 |
| 6,085,784 | A | | 7/2000 | Bloom et al. | |
| 6,106,027 | A | | 8/2000 | Mulvey et al. | |
| 6,220,297 | B1 | | 4/2001 | Marty et al. | |

* cited by examiner

*Primary Examiner*—Stephen M. Hepperle
(74) *Attorney, Agent, or Firm*—Cook, Alex, McFarron, Manzo, Cummings & Mehler, Ltd.

(57) ABSTRACT

A quick connect/disconnect faucet water conduit assembly includes at least one valve body and a spout nipple. There is a water tube extending from the valve body and a water tube extending from the spout nipple. A conduit has first and second terminations and there is a quick connect adapter attached to each of the first and second terminations. There are cooperating elements on each of the tubes and the quick connect adapters for locking the tubes to the adapters to thereby attach the valve body to the spout nipple.

10 Claims, 2 Drawing Sheets

14
10
12
16
20
18
22
24
34
60
40
26
28
30
32
60
60
42
44
36
38

QUICK CONNECT/DISCONNECT WATER FAUCET CONDUIT ASSEMBLY

THE FIELD OF THE INVENTION

The present invention relates to a quick connect/disconnect faucet water conduit assembly which facilitates the connection between a spout nipple and the valve bodies which control the flow of water to the spout nipple. Present practice in the installation of faucets, particularly kitchen faucets, which require a below deck water connection between the valve bodies and the spout nipple, necessitates a mechanical connection at each end of a water conduit. These may be soldered connections, or they may use a nut and a threaded end on the valve body. Either type of connection is time consuming and requires the installer to spend a considerable period beneath the sink deck.

The present invention provides a hose assembly which has a quick connect/disconnect adapter at each end thereof. The adapters are sealingly attached to the hose, which may be flexible, and cooperate and interlock with a tube which extends down from the valve body and the spout nipple. The installer need only snap the quick connect adapter onto the end of the water tube from the valve body and the water tube from spout nipple and the installation is complete. The hose may be disconnected by manipulating the clip on the adapter if there is a necessity to change out the valve body or the spout nipple.

SUMMARY OF THE INVENTION

The present invention relates to a faucet water conduit assembly which may be quickly connected and disconnected to a valve body and a spout nipple.

A primary purpose of the invention is to provide a water conduit assembly which utilizes quick connect adapters to form a watertight connection between one or more valve bodies and a spout nipple.

Another purpose of the invention is to provide a water conduit assembly for the use described utilizing quick connect adapters which cooperate and interlock with a tube which extends outwardly from a faucet spout nipple and a faucet valve body.

Other purposes will appear in the ensuing specification, drawings and claims.

BRIEF DESCRIPTION OF THE DRAWINGS

The invention is illustrated diagrammatically in the following drawings wherein.

DESCRIPTION OF THE PREFERRED EMBODIMENT

Figure 1:
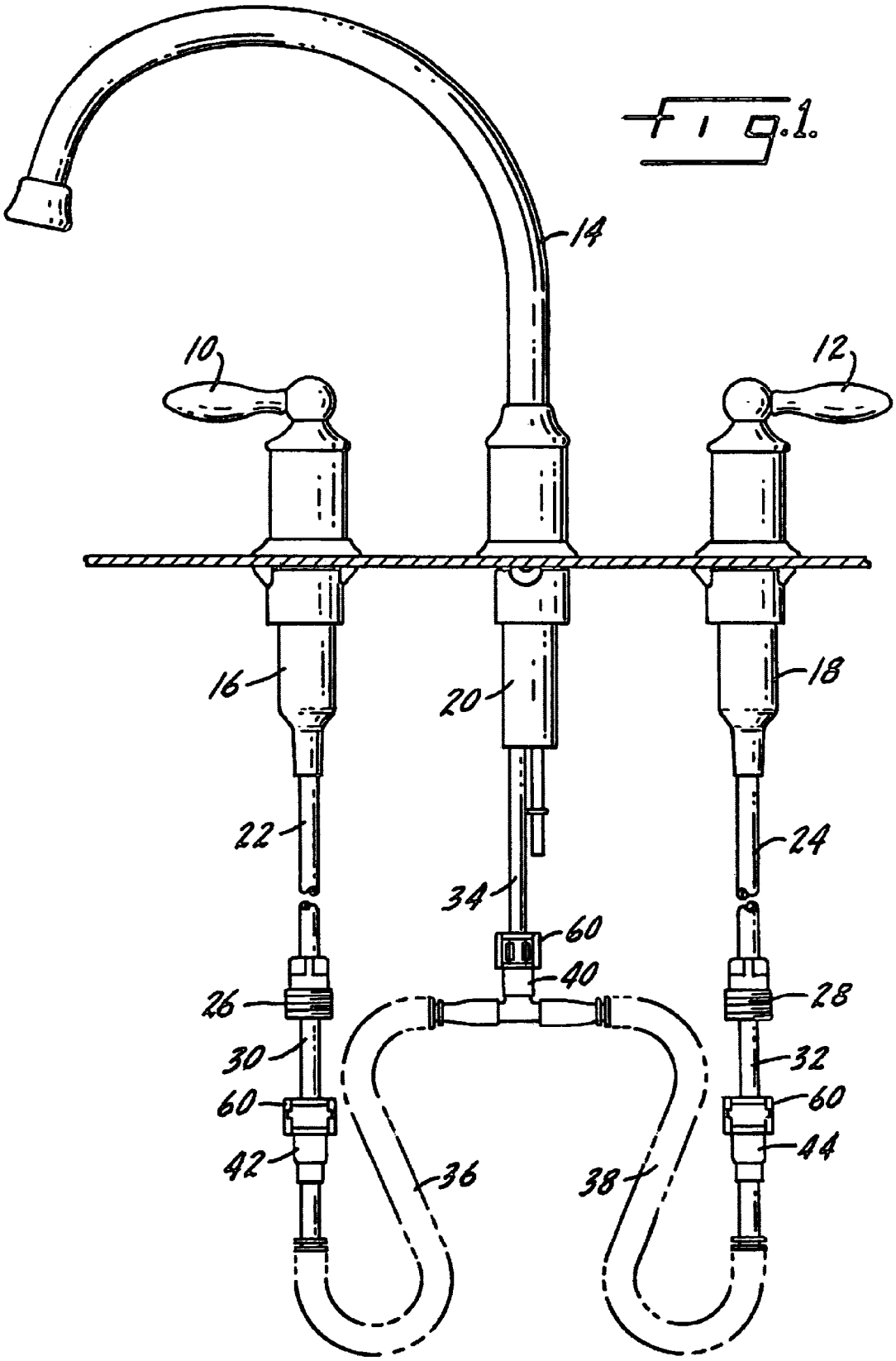
FIG. 1 is a diagrammatic illustration of a kitchen faucet assembly and the water conduit connections therebetween.

FIG. 1 illustrates a typical kitchen faucet installation. There are control handles 10 and 12 on each side of a faucet spout 14. Each of the handles 10 and 12 has a valve body indicated at 16 and 18, respectively, and the spout 14 has a spout nipple 20. Suitable valve cartridges, such as the MOEN 1224, may be positioned within the valve bodies. As is well known in the art, the handles control the flow of water from hot and cold water supplies to the spout nipple from which the water is discharged through the spout. The present invention is specifically concerned with the water connections between the valve bodies and the spout nipple.

Each of the valve bodies 16 and 18 has an inlet water conduit 22 and 24 extending downwardly therefrom, with each terminating in a connector 26 and 28, respectively. The valve bodies in turn each have a water outlet tube 30 and 32 at the end thereof. Similarly, the spout nipple body 20 has a tube 34 extending downwardly therefrom. The tubes 30, 32 and 34 and their connection to the hose assembly is illustrated in more detail in FIGS. 2–4.

Figure 2:
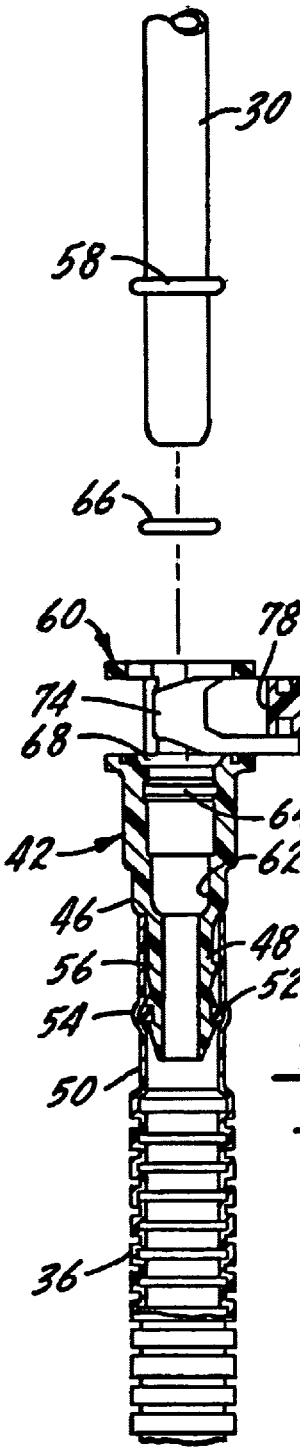
FIG. 2 is an exploded view of the hose connection between any one of the faucet fixtures shown in FIG. 1.
Figure 3:
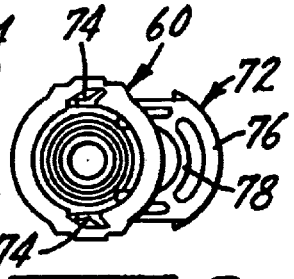
FIG. 3 is a top plan view of the quick connect adapter.
Figure 4:
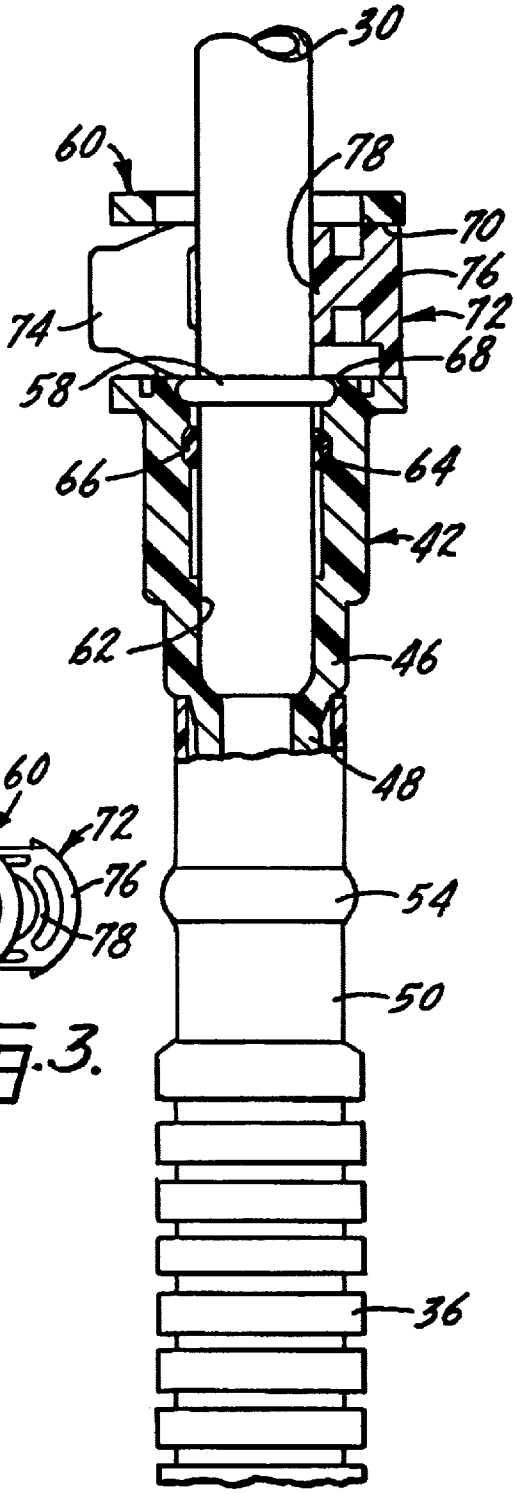
FIG. 4 is an enlarged view illustrating the connection between the adapter and the water tube from a valve body or spout nipple.

Also illustrated in FIG. 1 are a pair of water conduits or hoses 36 and 38. The hose 36 is connected between a pout nipple fitting 40 and a valve body fitting 42 and the hose 38 is connected between the spout nipple fitting 40 and the valve body fitting 44. FIGS. 2–4 represent and illustrate the connection between a water tube, whether it be any one of tubes 30, 32 and 34, and the valve body fittings 40, 42 and 44.

Focusing first on the connection between the hose and the valve body fitting, indicated at 42 in FIG. 2, the fitting may be made of a suitable plastic and has a cylindrical portion 46 having an outwardly extending barbed projection 48. The barbed projection 48 extends within a flexible portion 50 of the hose 36. There is a seal ring 52 on the barbed projection, and as shown, this will cause an expansion area 54 in the flexible hose portion 50. This provides a seal between the fitting and the hose. The barbs 56 function to secure the fitting to the hose. The combination of the barbed projection and seal provides a sealed secured connection between the hose and the fitting.

The tube 30 carries a shoulder 58 which will interlock with the quick connector indicated generally at 60. The fitting 42 has a chamber 62 which will receive the tube 30, as indicated in FIG. 4. The chamber has a recess 64 which receives the seal 66 which forms a seal between the tube and the fitting. The shoulder 58 will be received in a second recess 68 adjacent the upper end of the chamber 62 when the tube is fully inserted into the fitting.

The fitting 42 includes a second chamber 70 within which is positioned a clip 72 which locks the tube within the fitting. The spring clip is movable back and forth within the chamber 70 to effect an interlock with the tube 30 and the shoulder 58. The spring clip 72 has a pair of arms 74 connected together by a body portion 76, with the spring clip including a further portion 78 which bears directly against the tube 30 in the fully connected position of FIG. 4.

The clip 72 is movable within the chamber 70 and to effect a connection between the tube and the fitting, the clip will be in the extended position of FIG. 2. The tube 30 will be inserted until the shoulder 58 bottoms and is positioned within the recess 68. The clip 72 is then moved inwardly from the FIG. 2 position to the FIG. 4 position, in which case the clip overlies the upper end of the shoulder 58, as illustrated in the drawings, to firmly hold the tube 30 within the fitting. If it is desired to disconnect the hose from either the valve body or the spout nipple, the arms 74 will be squeezed together, allowing the clip to be moved from the FIG. 4 position to the FIG. 2 position, which permits removal of the tube 30.

Of importance in the invention is the ability to quickly connect the water conduits between valve bodies and the spout nipple without the installer requiring an excessive amount of time beneath the sink deck. The valve bodies and the spout nipple may be installed from above the sink deck and easily fastened in such position. The only installation which then must be made from beneath the deck is to attach the hose assembly between the valve body tubes and the tube connecting to the spout nipple. Although the invention is shown herein as having a single water conduit assembly which affects all connections, in some applications it may be desirable to have separate hose connections between the hot water supply valve body and the spout nipple, and a second hose which extends between the spout nipple and the cold water valve body. What is important is the quick disconnect assembly which permits a rapid seal-tight and secure connection with an audible snap between the various fixtures of the plumbing installation.

Whereas the preferred form of the invention has been shown and described herein, it should be realized that there may be many modifications, substitutions and alterations thereto.

The embodiments of the invention in which an exclusive property or privilege is claimed are as follows:

1. A quick connect/disconnect faucet water conduit assembly including at least one valve body and a spout nipple, a water tube extending from said valve body and a water tube extending from said spout nipple, a conduit having first and second terminations, a quick connect adapter attached to each of said first and second terminations, and cooperating means on each of said tubes and each of said quick connect adapters for removably locking each tube to an adapter to thereby attach said conduit between said spout nipple and said valve body, wherein said cooperating means includes an interlocking element on each tube, and a movable clip located in each quick connect adapter.

2. The faucet water conduit assembly of claim 1 wherein the interlocking element on each tube includes a shoulder formed thereon.

3. The faucet water conduit assembly of claim 1 wherein each clip is positioned within and movable within a chamber in each quick connect adapter.

4. The faucet water conduit assembly of claim 3 wherein each clip includes a pair of flexible arms permitting said clip to move inwardly and outwardly of said chamber.

5. The faucet water conduit assembly of claim 4 wherein the arms and each clip are joined by an arcuate portion of said clip, with said clip having an interior locking portion formed and positioned to interlock with a shoulder on a tube.

6. The faucet water conduit assembly of claim 2 wherein each quick connect adapter has a chamber and has an annular recess, spaced from the chamber, with said shoulder being positioned in said recess to hold said tube within said quick connect adapter.

7. The faucet water conduit assembly of claim 1 further including a second valve body having a water tube extending therefrom, a second conduit having first and second terminations, a quick connect adapter attached to a first termination of said second conduit and cooperating means on the tube of said second valve body and the quick connect adapter on the first termination of said second conduit for removably locking the tube of said second valve body to the quick connect adapter at the first termination of said second conduit.

8. The faucet water conduit assembly of claim 7 including a fixture supporting the quick connect adapter for said spout nipple, said fixture having means thereon for mounting terminations of said first and second conduits to connect both valve bodies to said spout nipple.

9. The faucet water conduit assembly of claim 8 wherein said fixture includes a body having first and second inlets and an outlet, with the inlets being attached to said first and second conduits and the outlet supporting the quick connect adapter for said spout nipple.

10. The faucet water conduit assembly of claim 9 wherein each of said conduits includes a hose having a flexible end thereon, the inlets of said fixture valve body each having a projection which extends into the flexible ends of said hoses, with the inlets including means for attaching the fixture body to the flexible end of the hoses.

* * * * *